US007749015B2

(12) United States Patent
Uchikawa et al.

(10) Patent No.: US 7,749,015 B2
(45) Date of Patent: Jul. 6, 2010

(54) CONNECTOR HOLDING CLAMP AND CONNECTOR RETAINING STRUCTURE

(75) Inventors: Ryuji Uchikawa, Chiyoda-ku (JP); Katsunao Aizawa, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/094,486

(22) PCT Filed: Nov. 21, 2006

(86) PCT No.: PCT/JP2006/323229

§ 371 (c)(1),
(2), (4) Date: May 21, 2008

(87) PCT Pub. No.: WO2007/060952

PCT Pub. Date: May 31, 2007

(65) Prior Publication Data

US 2009/0149055 A1 Jun. 11, 2009

(30) Foreign Application Priority Data

Nov. 25, 2005 (JP) ..... 2005-339850

(51) Int. Cl.
*H01R 13/627* (2006.01)

(52) U.S. Cl. ..... 439/362; 439/373

(58) Field of Classification Search ..... 439/362, 439/573, 926, 76.1, 373
See application file for complete search history.

(56) References Cited

U.S. PATENT DOCUMENTS

| | | | | |
|---|---|---|---|---|
| 3,867,672 | A * | 2/1975 | Pizzigoni | 361/774 |
| 4,091,246 | A | 5/1978 | Donofrio et al. | |
| 6,478,623 | B1 * | 11/2002 | Wu | 439/607.35 |
| 6,533,612 | B1 | 3/2003 | Lee et al. | |
| 7,077,698 | B2 | 7/2006 | Matthys et al. | |
| 2003/0008554 | A1 | 1/2003 | Chang | |

FOREIGN PATENT DOCUMENTS

| | | | |
|---|---|---|---|
| JP | 07-245147 | A | 9/1995 |
| JP | 10-172685 | A | 6/1998 |
| JP | 2001-135413 | A | 5/2001 |
| JP | 2005-259698 | A | 9/2005 |
| TW | 327481 | | 2/1998 |
| TW | 368199 | | 8/1999 |

* cited by examiner

*Primary Examiner*—Phuong K Dinh
(74) *Attorney, Agent, or Firm*—Sughrue Mion, PLLC

(57) ABSTRACT

An upper panel section includes an inserting hole into which a tip of a longitudinal-type equipment-side connector that is mounted on a PCB of an equipment at right angle and includes a spring section formed on its lateral surface is inserted. A foot section supports the upper panel section on the PCB. An inner circumference of the inserting hole has a shape surrounding substantially an entire circumference of the tip of the equipment-side connector. The foot section is provided at a position that opens up the lateral surface of the longitudinal-type equipment-side connector on which the spring section of the equipment-side connector is formed.

5 Claims, 16 Drawing Sheets

CONNECTOR HOLDING CLAMP AND CONNECTOR RETAINING STRUCTURE

TECHNICAL FIELD

The present invention relates to a structure for preventing a connector from being disconnected, and more particularly, to a structure for preventing a small-sized connector, such as a universal serial bus (USB) standard and the like, from being disconnected.

BACKGROUND ART

Recently, a small-sized connector, such as a USB standard connector, has become widely used. A factory automation (FA) apparatus, which is an apparatus such as a sequencer, a human machine interface (HMI), or a printer installed in a factory, is no exception where the small-sized connectors are begun to be commonly used. Because the FA apparatus is installed in more severe environments than an office automation (OA) apparatus, the FA apparatus requires higher reliability, robustness, and durability. In such an FA apparatus, it is not desirable for a cable connector connected to the FA apparatus to be disconnected by accident, because such disconnection could cause malfunction of facility machinery or data loss. However, a commercially available USB-mini type cable connector, for example, can get disconnected from an equipment-side connector if approximately 1 kg of a pulling weight is applied.

To solve this problem, it has been conventionally suggested to put on a resin holder onto the cable connector provided with a tab, and to engage the tab into an engaging hole provided on the apparatus, realizing a structure that can tolerate a heavy pulling weight (see, for example, Patent Document 1).

[Patent Document 1] Japanese Patent Application Laid-open No. 2001-135413 (FIG. 1)

DISCLOSURE OF INVENTION

Problem to be Solved by the Invention

However, in the connector retaining holder disclosed in Patent Document 1, because the apparatus and the holder are engaged using the tab and the engaging hole, an enough supporting force for preventing the connector from being disconnected cannot be achieved. Therefore, the connector retaining holder cannot prevent the connector from being disconnected if a heavy pulling weight is applied. For the FA apparatus described above, it is preferable to be tolerable against a pulling weight of approximately 6 kg. Furthermore, in the structure of the connector retaining holder disclosed in Patent Document 1, the connector is disengaged by pushing both sides of the thin-walled holder to move positions of the tab inside. Therefore, the connector can get disconnected easily as mentioned above, and the holder still has other unsolved problems. For example, because the material of the holder is vulnerable to temporal degradation, the tab may be deformed or break off from a base easily.

In addition, it is preferable for the FA apparatus, especially a stationary HMI for example, to have a structure to enable a cable connector, often inserted and removed such as one of USB-mini type, to be connected to the rear side of the apparatus at right angle, and not to a lateral side of the apparatus. This is because, the connection can be checked easier with eyes, and better workability can be achieved upon inserting or removing. However, the structure of a so-called straight type equipment-side connector is more vulnerable to damage than a so-called right-angle type equipment-side connector. To realize a structure that connects a small-sized cable connector at right angle to the rear side of a thin apparatus, such as a liquid crystal display, the straight type equipment-side connector is required. The right-angle type equipment-side connector is used to connect the cable connector to a lateral side of the apparatus. Because such a straight type equipment-side connector can get damaged easily, it is not suitable for the FA apparatus.

In addition, it has been a problem that, upon connecting or removing the USB connector, static electricity charged at an operator side can get discharged into electronic components of the apparatus via the USB connector, causing the apparatus to fail. In addition, it is also a problem that the USB connector generates an emission noise that affects other apparatuses.

The present invention has been achieved to solve the above problems, and it is an object of the present invention to realize a connector retaining holder and a connector retaining structure that can achieve an enough supporting force for a small-sized cable connector, and can reliably prevent disconnection of the connector upon application of a heavy pulling weight, and more particularly, to realize a connector holding clamp and a connector retaining structure that can reduce disconnection of a cable connector by preventing the connector from being damaged, for a structure that the cable connector can be connected to the rear side of a thin apparatus at right angle.

Means for Solving Problem

To solve the above problems and to achieve the object, a connector retaining holder according to the present invention prevents a cable connector, which is connected to an equipment-side connector provided on an equipment in a direction perpendicular to a surface of the equipment, from being disconnected from the equipment-side connector. The connector retaining holder includes a holding section that supports at least a rear end of the cable connector, which includes a contacting surface that makes a contact with a rear end surface of the cable connector, and a fastening section that is formed in a flange-like shape and is fastened onto the equipment with a fastening screw.

Furthermore, a connector holding clamp according to the present invention includes an upper panel section including an inserting hole into which a tip of a longitudinal-type equipment-side connector, which is mounted on a printed-circuit board (PCB) of equipment at right angle, is inserted and a foot section that supports the upper panel section on the PCB.

Moreover, a connector retaining structure according to the present invention includes a connector retaining holder that prevents a cable connector, which is coupled to a longitudinal-type equipment-side connector provided on a PCB of an equipment at right angle, from being disconnected from the equipment-side connector, which includes a holding section that supports at least a rear end of the cable connector, the holding section including a contacting surface that makes a contact with a rear end surface of the cable connector, and a fastening section that is formed in a flange-like shape and is fastened onto the equipment with a fastening screw; and a mounting base that is provided on the equipment, on which the fastening section of the connector retaining holder is mounted.

Furthermore, a reinforced equipment-side connector according to the present invention includes a longitudinal-type connector section provided on a PCB of equipment at right angle and a supporting member that supports a tip of the connector section on the PCB.

Moreover, an FA apparatus according to the present invention includes a PCB; a longitudinal-type equipment-side connector that is provided on the PCB at right angle; and a connector holding clamp including an upper panel section that is provided with an inserting hole into which a tip of the equipment-side connector is inserted and is arranged substantially in parallel to the PCB, and a foot section that supports the upper panel section on the PCB.

The term "apparatus" herein means an apparatus such as a HMI, and the term "equipment" herein includes the "apparatus" and other elements such as a control panel. "Connector-inserted direction" means a direction in which a cable connector is inserted and removed with respect to an equipment-side connector, which is a direction on which the center axis of the cable connector is laid. "Flange-like" describes how an element is extended from an end thereof to an approximately perpendicular direction.

Effect Of The Invention

According to a connector retaining holder of the present invention, the holder is fastened to an apparatus using a fastening screw. Therefore, a sufficient force can be obtained to prevent disconnection of the connector, so that the connector can be reliably prevented from being disconnected even when a heavy pulling weight is applied.

Furthermore, according to a connector holding clamp of the present invention, a tip of an equipment-side connector is inserted into and supported in an inserting hole. Therefore, the connector can be prevented from being damaged, such as an opening thereof being opened up or the connector being folded over, and the disconnection of a cable connector can be suppressed.

Moreover, according to a connector retaining structure of the present invention, the holder is fastened to the apparatus using the fastening screw. Therefore, an enough supporting force can be obtained to prevent the disconnection of the connector, so that the connector can be reliably prevented from being disconnected even when a heavy pulling weight is applied. At the same time, because a mounting base supports the holder more securely, the cable connector can be prevented from being disconnected more reliably.

Furthermore, according to a reinforced equipment-side connector of the invention, because a tip of a connector section is secured, damages can be reliably prevented, such as the connector section being folded over.

Moreover, according to an FA apparatus of the present invention, the tip of the equipment-side connector is inserted into and supported in the inserting hole. Therefore, the connector can be prevented from being damaged, such as the opening thereof being opened up or the connector being folded over, and the disconnection of the cable connector can be suppressed.

BRIEF DESCRIPTION OF DRAWINGS

FIG. 11 is a schematic of the connector retaining holder, seen from the side on which a contact portion protrudes from.

EXPLANATIONS OF LETTERS OR NUMERALS

Figure 1:
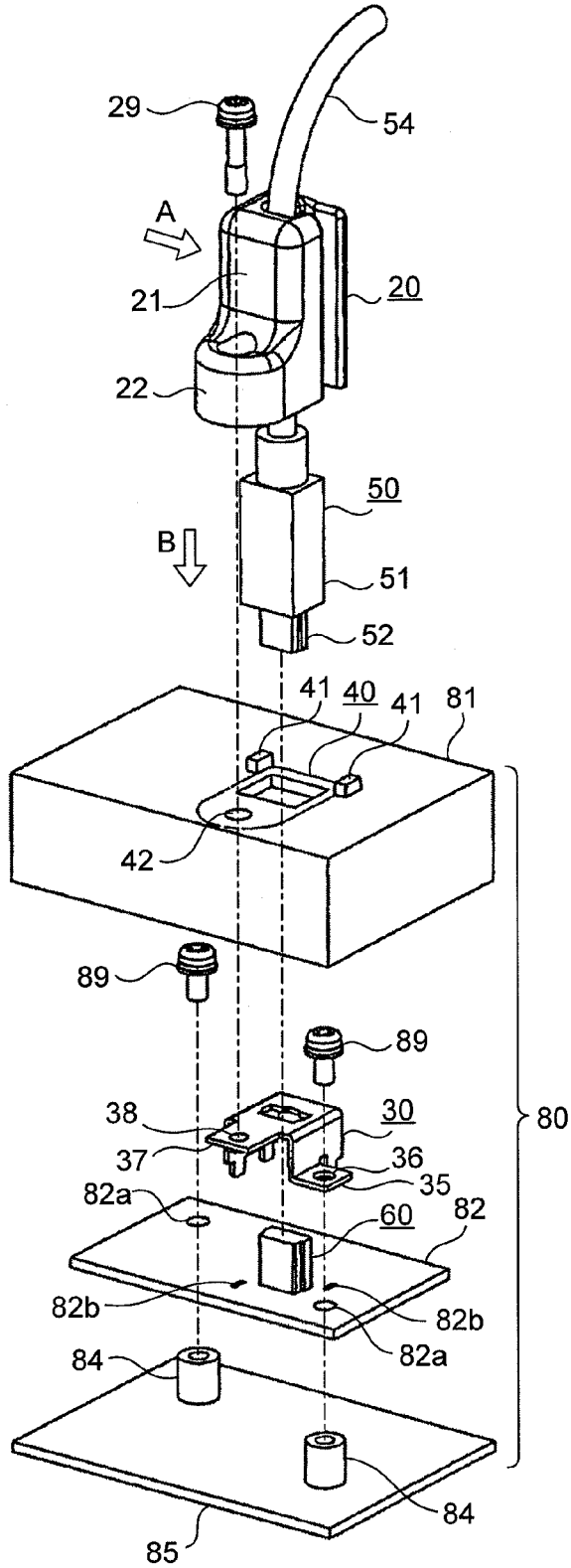
FIG. 1 is a schematic perspective view of a connector retaining structure according to a first embodiment of the present invention.

20 Holder (connector retaining holder)
21 Holding section
22 Fastening section
23 Notch
29 Fastening screw
24 Screw inserting hole
24*a* Counterbore
25 C-shaped engaging section
26 Rib
26*a* Ending point of slope on a rib
26*b* Starting point of slope on a rib
27 Chamfer with an arc-shaped cross-section
30, 130, 230, 330, 430, 530 Connector holding clamp
31, 231 Upper panel section
32, 232 Foot section
33 Inserting hole
33*a* Clearance
34 Soldering tab on foot section
35 Mounting flange
36 Penetrating hole
37 Coupling section
38 Linking screw hole
40, 140 Mounting base
41 Rotation stopper
42 Female screw hole (penetrating hole)
50 USB male cable connector (cable connector)
51 Housing
52 Contact portion
53 Flexible portion
54 Cable
60 Vertical-type USB female equipment-side connector (equipment-side connector)
61 Shell
62 Soldering tab on shell
63 Leads
64 Terminal portion
65 Retaining flat spring (spring section)
80, 180 Apparatus
81 Case
82 PCB
82*a* Penetrating hole for fixing
82*b* Inserting hole
83 PCB fixing screw
84 Spacer
85 Base
90 HMI
91 USB extension cable
100 Box-type control panel
141 Surrounding wall
240 Mounting base piece
131 Upper panel section
132 Foot section
160, 260, 360 Connector section
170, 270, 370 Reinforced equipment-side connector
261 Engaging section
261*a* Upper protrusion
261*b* Lower protrusion
331A First upper panel section
331B Second upper panel section
332A First foot section
332B Second foot section
361 Shell

BEST MODE(S) FOR CARRYING OUT THE INVENTION

Exemplary embodiments of a connector retaining holder, a connector holding clamp, and a connector retaining structure according to the present invention will be explained in detail below with reference to the accompanying drawings. It should be understood that the embodiments are not intended to limit the scope of the invention in any way.

First Embodiment

Figure 2:
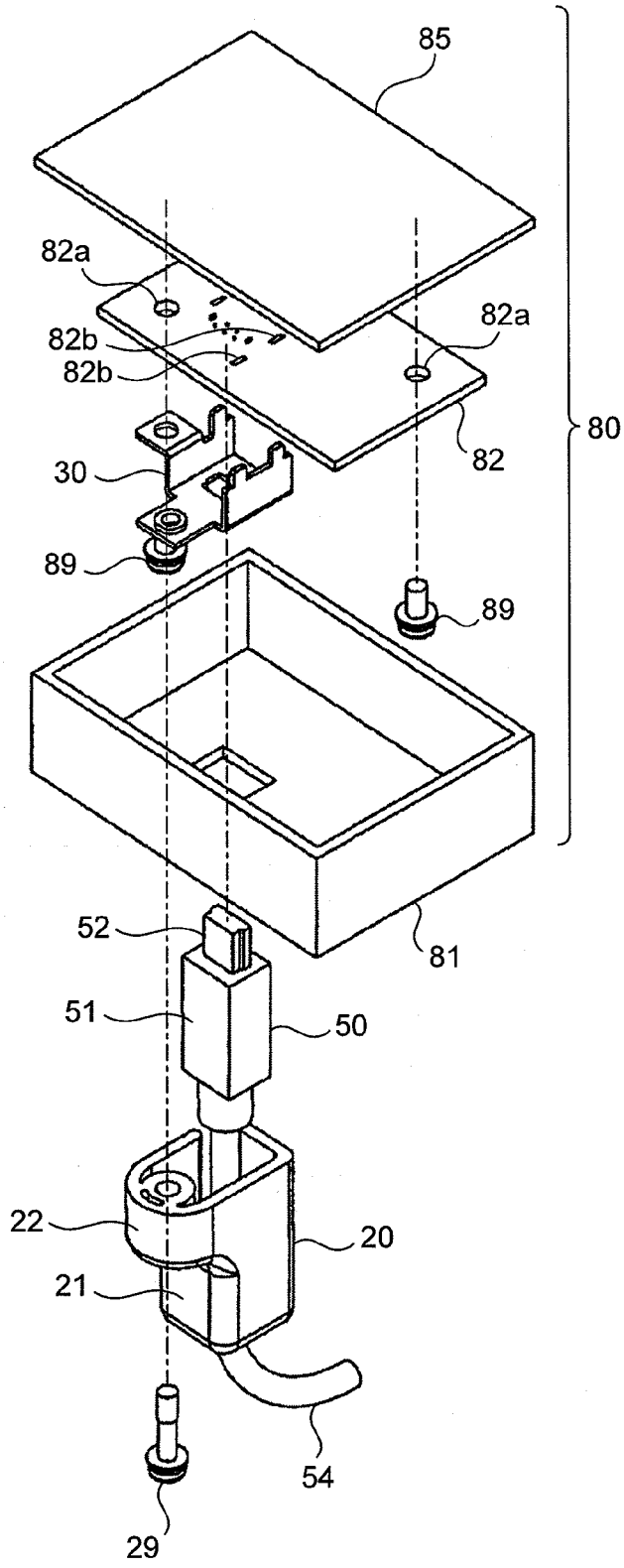
FIG. 2 is a perspective view of the connector retaining structure shown in FIG. 1, viewed from a different direction.

FIG. 1 is a schematic perspective view of a connector retaining structure according to a first embodiment of the present invention. FIG. 2 is a perspective view, viewed from another direction, of the connector retaining structure shown in FIG. 1. The connector retaining structure according to the first embodiment includes: a connector holding clamp 30 that prevents a vertical-type USB female equipment-side connector (USB-mini connector) 60 provided onto a PCB 82 at right angle, which is built into an apparatus 80, from being folded over; a connector retaining holder 20 that prevents a USB male cable connector (USB-mini plug) 50, connected with the vertical-type USB female equipment-side connector 60, from being disconnected; and a mounting base 40, formed on the external wall surface of a case 81 of the apparatus 80, onto which the holder 20 is mounted.

Figure 3:
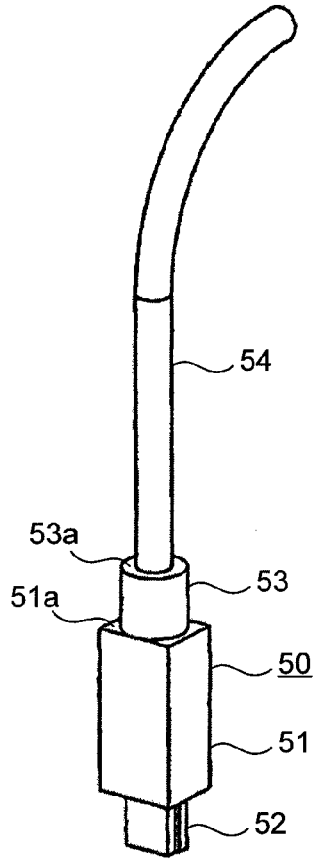
FIG. 3 is perspective view of a generally-available USB male cable connector.

FIG. 3 is a perspective view of the USB male cable connector (hereinafter, simply referred to as "cable connector") 50 that is generally available. The connector retaining holder (hereinafter, simply referred to as "holder") 20 according to the first embodiment prevents the cable connector 50, having the shape shown in FIG. 3, from being disconnected. In FIG. 3, the cable connector 50 includes: a housing 51, made of resin, that is formed on one end of a cable 54 and having a approximate shape of an quadrangular prism; a contact portion 52, made of metal, that is mounted at the tip of the housing 51 and are mechanically and electronically connected to the vertical-type USB female equipment-side connector 60; and a flexible portion 53, made of resin, that covers the cable 54 at the rear end of the housing 51 and has a high flexibility so as to prevent the cable 54 from being bent at a sharp angle. A terminal portion, not shown, is provided inside the contact portion 52.

Figure 4:
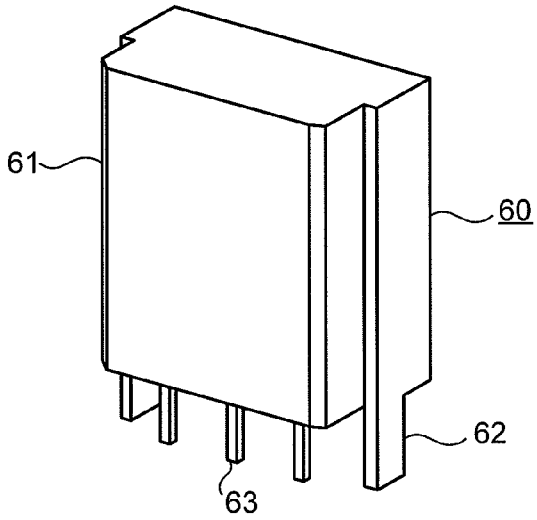
FIG. 4 is a perspective view of a vertical-type USB female equipment-side connector.

FIG. 4 is a schematic perspective view of the vertical-type USB female equipment-side connector (hereinafter, simply referred to as "equipment-side connector) 60. The equipment-side connector 60, shown in FIG. 4, is the so-called straight-type equipment-side connector that realizes a structure connecting the cable connector to the rear side of the thin apparatus at right angle. The connector holding clamp 30 according to the first embodiment prevents this straight-type equipment-side connector from being folded over. In FIG. 4, the equipment-side connector 60 has a shell 61 that is made from a thin plate metal formed in approximately tubular in shape. The shell 61 has a terminal portion, not shown, inside thereof. A soldering tab 62 is formed, with the lateral sides thereof extended, at the rear end of the shell 61. The soldering tab 62 is used for fixing the shell 61 onto the PCB. Leads 63, extending from the terminal portion located inside the shell 61 and connected electrically to a pattern on the PCB, are also provided at the rear end of the shell 61.

Figure 5:
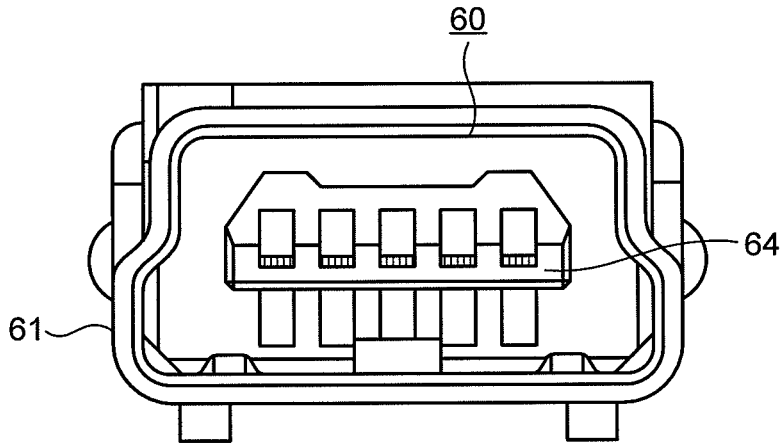
FIG. 5 is a top view of the vertical-type USB female equipment-side connector, showing details thereof.
Figure 6:
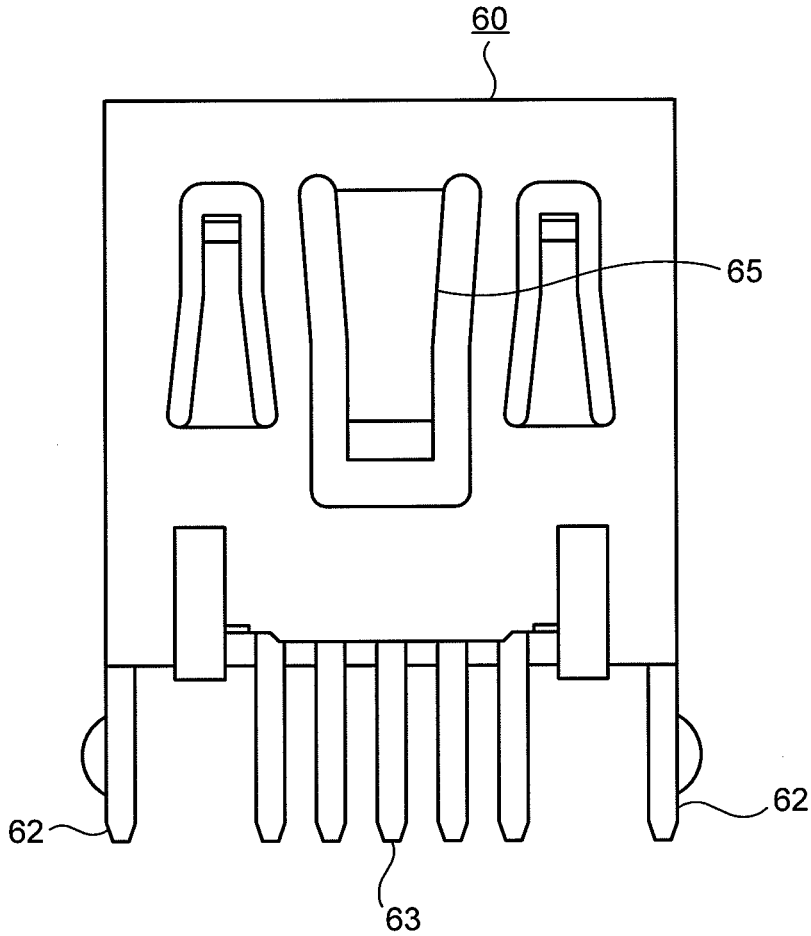
FIG. 6 is a side view of the vertical USB female equipment-side connector, showing details thereof.

FIG. 5 is a top view of the equipment-side connector 60, showing details thereof. FIG. 6 is a side view also of the equipment-side connector 60, showing details thereof. A terminal portion 64, electrically connected to the terminal portion located inside the contact portion 52 of the cable connector 50, is arranged inside the shell 61. On a lateral side of the shell 61, a flat disconnection-preventing spring 65 is formed to prevent the cable connector 50 from being disconnected with a small force (approximately 1 kilogram). A specific example of the equipment-side connector 60 includes a connector manufactured by Nihon Molex K.K., a part number 500075-0517. The equipment-side connector 60 having the structure described above is placed on the PCB in a vertical direction with an opening of the shell 61 facing upward, and fixed onto the PCB by soldering the tab 62 to the PCB. Therefore, it is possible to realize a connector structure with the shell arranged at right angle with the PCB (FIG. 1), without arranging a PCB vertically, in comparison with a so-called right-angled type equipment-side connector, in which the shell is arranged horizontally on the PCB. However, the straight-type shell 61 is made from a thin metal formed in an approximate tubular shape, and meeting edges of the thin metal are not especially connected, such as by welding. Therefore, the opening of the shell 61 can be opened up easily and get damaged, if the edge is twisted by the contact portion 52 of the cable connector 50 that is inserted inside thereof. Furthermore, because the shell 61 is supported at the bottom end thereof only on an area obtained by projecting the cross section of the shell 61 onto the PCB, the shell 61 can be easily folded over, thus be peeled off from the PCB or broken off from the base, if a force is applied from a lateral direction.

Figure 7:
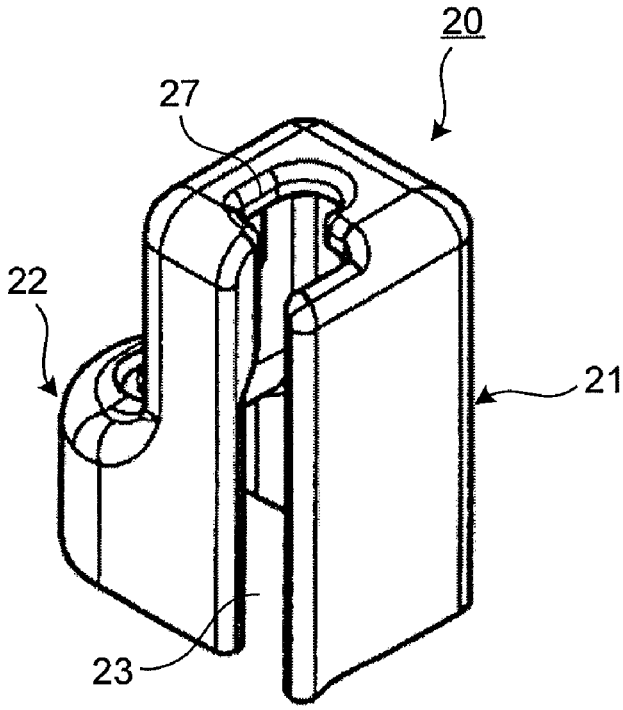
FIG. 7 is a perspective view of a connector retaining holder, showing details thereof.
Figure 8:
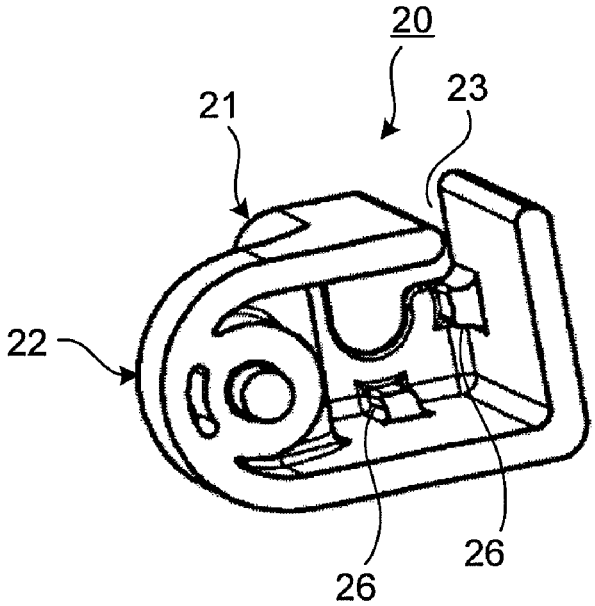
FIG. 8 is a perspective view of the connector retaining holder, seen from the side of a fastening section, showing details thereof.
Figure 9:
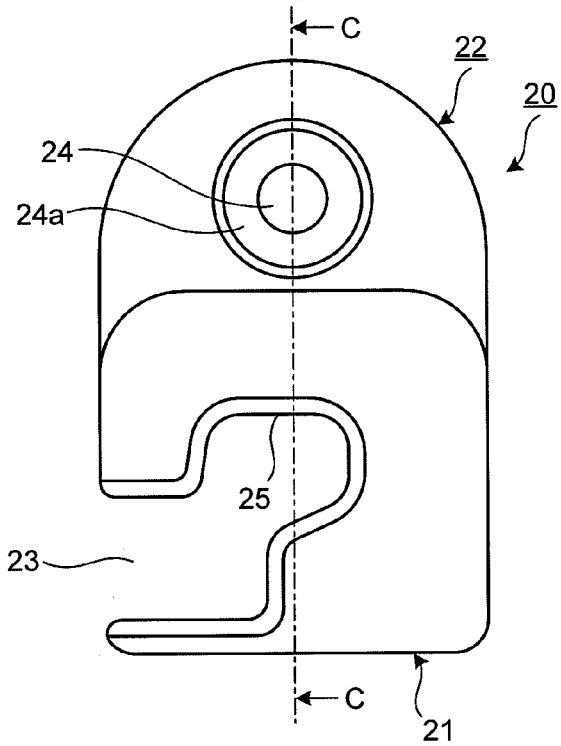
FIG. 9 is a schematic of the connector retaining holder, seen from the side from which a cable extends out.
Figure 10:
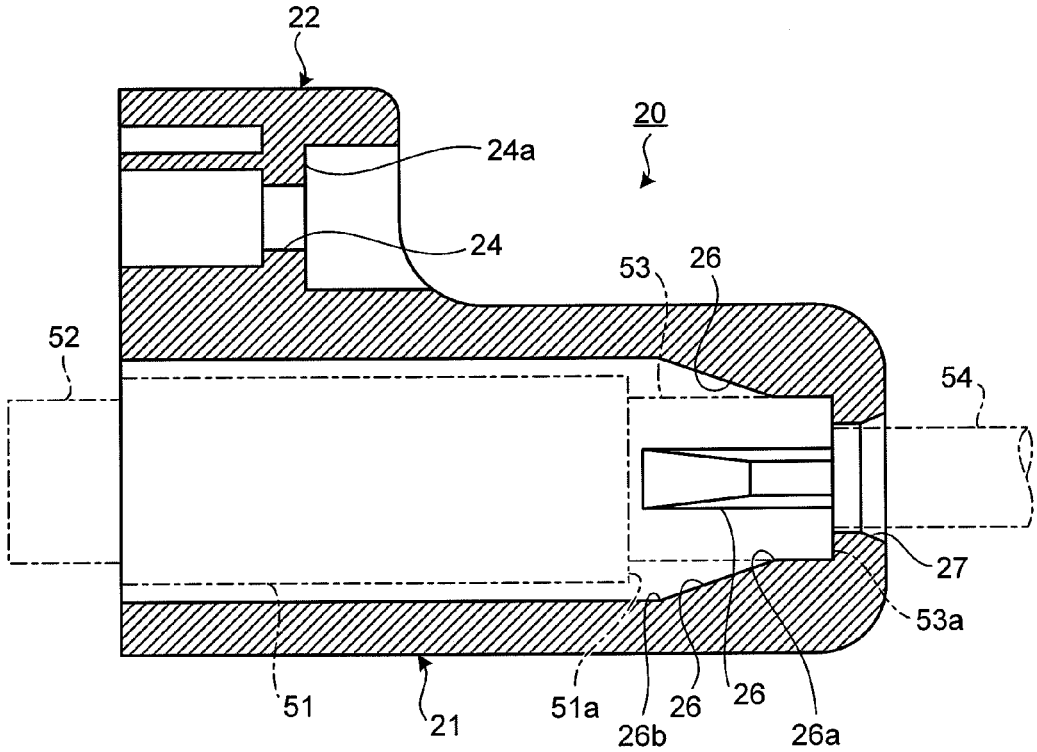
FIG. 10 is a sectional view along the line C-C shown in FIG. 9, seen from the direction of arrows.
Figure 11:
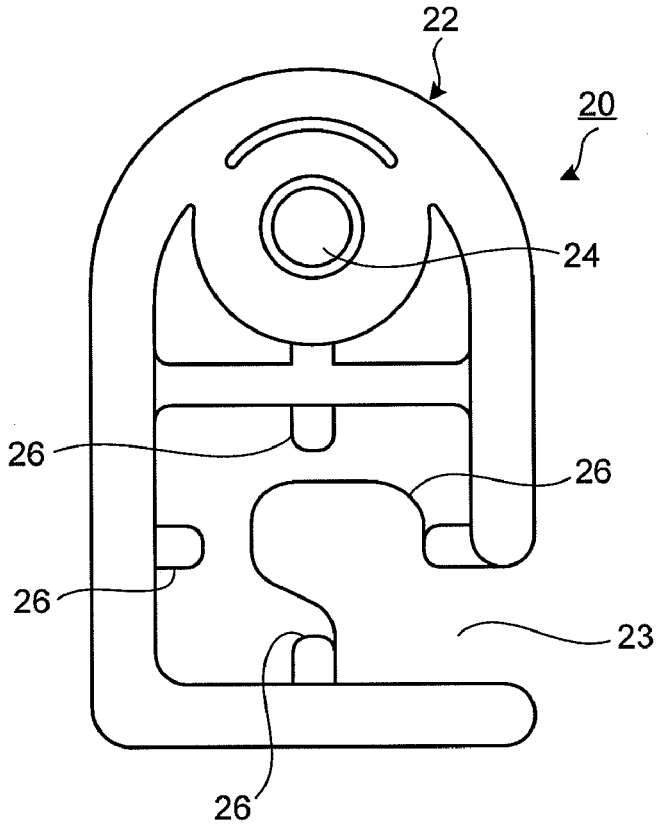

FIG. 7 is a perspective view of the holder 20 according to the first embodiment, showing details thereof. FIG. 8 is another perspective view of the same holder 20, seen from a fastening side thereof, showing details thereof. FIG. 9 is a schematic of the holder 20, seen from the side from which the cable 54 extends out. FIG. 10 is a sectional view along the line C-C shown in FIG. 9, viewed from the direction of arrows shown therein. FIG. 11 is a schematic of the holder 20, seen from the side on which the contact portion 52 protrudes from. FIG. 10 shows, in phantom lines, how the cable connector 50 fits inside the holder 20. In FIGS. 7 to 11, the holder 20 is made of resin, and formed as a single piece, for example, such as by injection molding. The holder 20 includes: a holding section 21, formed approximately tubular in shape, for accepting the cable connector 50 inside thereof; and a fastening section 22 that is formed in a flange-like shape on the holding section 21, on the side thereof facing to the apparatus 80. The material of the holder 20 is not limited to resin, and materials such as metal can also used. In addition, the holder 20 is not limited to injection molding, and may also be manufactured by die casting or cutting.

As can be seen well in FIG. 7, the holding section 21 has an approximate tubular shape inside thereof for accepting the cable connector 50. The holding section 21 also has a notch 23, whose width is slightly larger than the diameter of the cable 54, over its entire longitudinal length. Therefore, the cable 54 can be inserted from the side of the holding section 21 (from the radial direction), that is, from a direction perpendicular to the axis of the holding section 21. A size of the holding section 21 is determined so that a predetermined space is formed between the cable connector 50 and an internal wall surface thereof, allowing the cable connector 50 to be accepted even when the cable connector 50 is rotated by 90 degrees (actually, the rotation may be by any angle within 360 degrees,) around the axis thereof.

Moreover, as can be seen well in FIGS. 7 and 9, a C-shaped engaging section 25, to be fit onto the cable 54 with some play remaining, is provided on the rear end side of the holding section 21, that is, on the side thereof from which the cable 54 extends out. The inner diameter of the C-shaped engaging section 25 is set slightly larger than the outer diameter of the cable 54. The opening of the C-shaped engaging section 25 is communicated with the notch 23, so that the cable 54 can be inserted from the side direction. The opening of the C-shaped engaging section 25 may be made slightly smaller in width than the outer diameter of the cable 54, so that the cable 54, having an elastic cover, can pass therethrough by applying a force, achieving better supportability of the cable connector 50. The external surface of the C-shaped engaging section 25, that is, the rear end surface of the holding section 21, has a chamfer 27 with an arc-shaped cross-section, so that the cable 54 is not prevented from being bent at the rear of the holding section 21.

The inner surface of the C-shaped engaging section 25 comes in contact with the rear end surface of the cable connector 50 (rear end surface 53*a* of the flexible portion 53), as shown in FIG. 10. The holder 20 supports the contacting surface at a fixed position with respect to the equipment-side connector 60, limiting backward movements of the cable connector 50, to prevent the cable connector 50 from being disconnected. The contacting surface according to the first embodiment comes in contact with the rear end surface of the 53*a* of the flexible portion 53; however, a contacting surface, coming in contact with a rear end surface of the housing 51, may be formed by providing a protrusion or a step on the internal wall surface of the holding section 21.

Two pairs of ribs 26, four in total, are formed on the internal wall of the holding section 21. Each of the ribs has a tapered ridge, and these ridges, each one facing to another, are gradually made smaller in width, as the ridges extend toward the C-shaped engaging section 25. The ribs 26 are formed so that, when the cable connector 50 is accepted, an ending point 26*a* of the slope does not interfere with the rear end surface 51*a* of the housing 51, and a starting point 26*b* of the slope does not interfere with the flexible portion 53. It would not be a problem for the flexible portion 53 to interfere with the ribs 26, if the flexible portion 53 has enough flexibility, as long as the stress does not cause damage or failure.

As will be mentioned later in description of an attachment procedure, the cable connector 50 is tightly nipped at the flexible rear end of the flexible portion 53 by these four ribs 26. In other words, the four ribs 26 function as a nipping unit that nips the rear end of the cable connector 50, because the upper surface of the ridge of the rib 26 (the surface facing to the center axis) has a tapered surface (nipping surface) in the height direction, becoming gradually higher toward the rear end side of the holding section 21. The holder 20, having the rib shape, holds the nipping unit at a fixed position with respect to the equipment-side connector 60, suppressing movements of the rear end of the cable connector 50 in a direction perpendicular to the axis thereof.

By nipping the cylindrical flexible portion 53 that has the same axis as the cable 54, the nipping unit, having the four ribs 26, realizes a structure that can support the cable connector 50 even when the cable connector 50 is rotated by 90 degrees (actually, the rotation may be by any angle within 360 degrees).

The nipping unit according to the first embodiment includes the four ribs 26, as described above. However, the nipping unit may also include, for example, three ribs 26. Furthermore, the nipping unit can be formed by providing at least one rib 26 and the internal wall surface facing thereto to nip the rear end of the cable connector 50. This arrangement simplifies the shape, with some sacrifice of the supportability.

Still furthermore, inside of the holder 20 may have a conical-trapezoidal shape that is obtained by rotating the tapered surface (the slope surface from the starting point 26*b* to the ending point 26*a* of the slope) of the rib 26 around the center axis, to be used as a nipping surface. This arrangement can also prevent the rear end of the cable connector 50 from moving in a direction perpendicular to the axis thereof.

As can be seen well in FIG. 10, a screw inserting hole 24, provided with a deep counterbore 24*a*, is formed for a screw on the apparatus side of the external end surface of the fastening section 22. The fastening section 22 extends approximately at right angle from the holding section 21 toward a predetermined direction. A large attaching surface that makes a contact with the mounting base 40, is formed on the end surface of the fastening section 22 and that of the holding section 21. The holder 20 is fastened onto the apparatus 80 (mounting base 40) with a fastening screw, not shown, penetrating through the screw inserting hole 24 for the screw. The head of the fastening screw sinks into the counterbore 24*a*, thus, becoming no obstacle upon working therewith.

Figure 12:
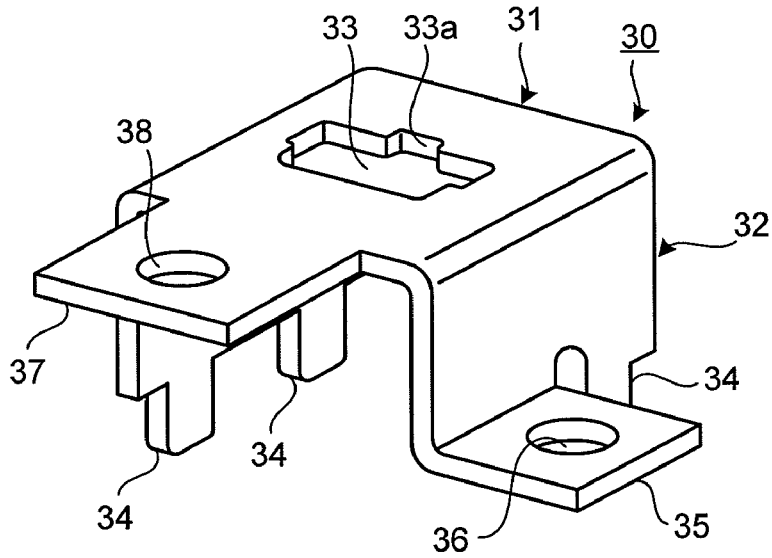
FIG. 12 is a perspective view of a connector holding clamp, showing details thereof.

FIG. 12 is a perspective view of the connector holding clamp 30, for showing details thereof. The connector holding clamp 30 is made from a metal plate being cut out in a laser process or punched out in a pressing process, and being bent in a bending process to be formed into an approximate U-shaped cross-section connector holding clamp 30. On the entire surface of the connector holding clamp 30, nickel plating, for example, is provided to improve workability upon soldering.

The connector holding clamp 30 is arranged approximately in parallel to the PCB 82 (FIG. 1), and includes an upper panel section 31, provided with inserting holes 33 for inserting the tip of the equipment-side connector 60, and a pair of foot sections 32 for supporting the upper panel section 31 on the PCB 82. A coupling section 37, extending from the upper panel section 31, is provided on one of the sides of the upper panel section 31 not having the foot section 32, to stabilize the connection with the holder 20. A linking screw hole 38 is threaded on the coupling section 37, and a fastening screw 29 penetrates through the fastening section 22 of the holder 20 to be screwed therein.

One of the pair of the foot sections 32, provided to each side of the upper panel section 31, has two soldering tabs 34 at a bottom end thereof. The other foot section 32 has a single soldering tab 34 and a mounting flange 35 at a bottom end thereof.

Figure 13:
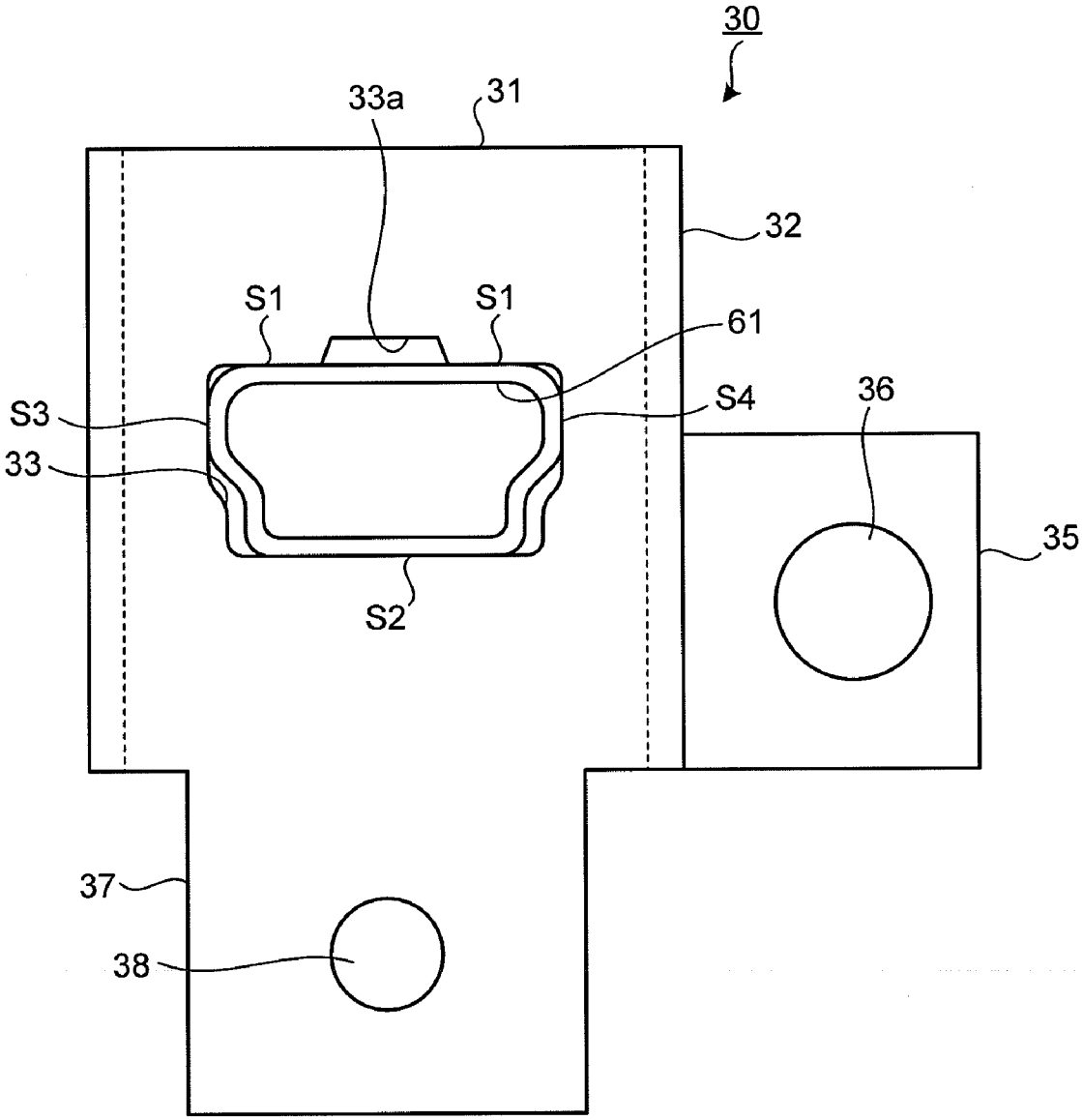
FIG. 13 is a top view of the connector holding clamp, explaining the relationship between an inserting hole thereof and a shell of an equipment-side connector.

FIG. 13 is a top view of the connector holding clamp 30, provided to explain the relationship between the shape of the inserting hole 33, provided on the connector holding clamp 30, and that of the shell 61 of the equipment-side connector 60. Functions of the connector holding clamp 30 are explained with reference to FIG. 13. As shown in FIG. 13, the shape of the inserting hole 33, formed on the upper panel section 31, follows the external contour of the shell 61. In other words, the inserting hole 33 has a shape that the tip of the shell 61 just fits into with a predetermined size tolerance, and forms a surrounding section that surrounds the tip of the shell 61. The connector holding clamp 30 supports the inserting hole 33 (surrounding section) at a fixed position with respect to the PCB 82 (FIG. 1), preventing the shell 61 from being folded over in all directions therearound, and from being damaged by the tip opening thereof being opened up.

A clearance 33*a* is provided on a part of the inner surface edge of the inserting hole 33, so that the movement of the retaining flat spring 65 of the equipment-side connector 60, is not abstained. The inserting hole 33 according to the first embodiment aligns the shell 61 in width direction and prevents the opening of the shell 61 from being opened up by nipping the shell 61 between inner surfaces S1 and S2 shown in FIG. 13. At the same time, the inserting hole 33 aligns the shell 61 in a length direction and prevents the opening of the shell 61 from being opened up by nipping the shell 61 between inner surfaces S3 and S4. As obvious it might be from the above, even if another shape is used for the inserting hole 33 (for example, a simple rectangle with the clearance 33*a* above), an approximately similar effect can be achieved, as long as the inserting hole 33 has at least two pairs of inner surfaces (limiting sides), four in total, although the supportability for the opening of the shell 61 might be somewhat sacrificed. Alternatively, the inserting hole 33 may touch the shell 61 at the points shown as S1 to S4, further sacrificing the shape supportability.

In addition, some improvement might be made to the inserting hole 33, for example, by forming a part of the inner surface edge thereof in an accordion-like cross-section shape. In this arrangement, the inner surface edge of the inserting hole 33 has elasticity that generates resiliency in a direction that shrinks the size of the inserting hole 33. By way of this resiliency, that part of the inserting hole 33 is constantly kept in contact with the shell 61, to improve the supportability.

According to the first embodiment, upon being manufactured by being punched out by a press, the connector holding clamp 30 is punched out from the PCB side of the upper panel section 31. Generally speaking, if a hole is formed with a press, the edge of an opening becomes slacked and rounded out on a side that faces a male press. On the contrary, on the opposite side, burrs are formed on the edge of the opening. Therefore, if the metal plate is pressed in the direction described above, the edges of the opening of the inserting hole 33 becomes slacked and rounded out on the PCB side. Therefore, the equipment-side connector 60 can be inserted more easily, improving workability of an assembly process.

Referring back to FIG. 1, the connector holding clamp 30 is fixed onto the PCB 82, by the tabs 34 thereof being inserted into inserting holes 82*b* and being soldered onto the PCB 82. The tabs 34 are soldered in the same soldering process as for other electric components provided onto the PCB 82.

In addition to the soldered tab 34, the connector holding clamp 30 is fastened onto a spacer 84 with a PCB fixing screw 89 passing through a penetrating hole 36 formed on the mounting flange 35. In other words, the PCB fixing screw 89 is also used for fixing the connector holding clamp 30. If there is a concern that external static electricity (from the operator) might cause damage or a failure of the apparatus or affect nearby apparatus, or the USB connector might generate an emission noise, the shell needs to be brought down to the signal ground. The connector holding clamp 30 according to the first embodiment establishes an electrical connection with the shell 61 and a base (signal ground) 85 through the spacer 84. In this manner, the shell can be reliably brought down to the signal ground easily. The connector holding clamp 30 may be used to connect not only to the signal ground, but also to the frame ground.

A method for attaching the holder 20 will be now explained. The holder 20 accepts the cable 54 from the side direction thereof by moving the holder 20 in the direction shown by an arrow A in FIG. 1. The cable connector 50 is then moved in a direction shown by an arrow B, to be accepted into the holding section 21. At this time, the cable connector 50 is forcibly pushed into the holding section 21, so that the cable connector 50 is seized by the four ribs 26 (FIG. 10) described above. The holder 20, with this arrangement, is settled onto the mounting base 40 to connect the cable connector 50 with the equipment-side connector 60. The fastening screw 29, penetrating through the fastening section 22, is screwed into the linking screw hole 38 via a penetrating hole 42. In this manner, the holder 20 is securely fixed onto the apparatus 80. Because the holder 20 is fixed by the single fastening screw 29, the holder 20 could attempt to rotate around the fastening screw 29; however, this rotating movement is confined by rotation stoppers 41. The linking screw hole 38 should be used for fastening the fastening screw 29, as required. If the inner surface of the case 81 does not come in contact with the coupling section 37, the penetrating hole 42 is used as a female screw hole 42, and the fastening screw 29 is screwed only into the female screw hole 42.

Figure 14:
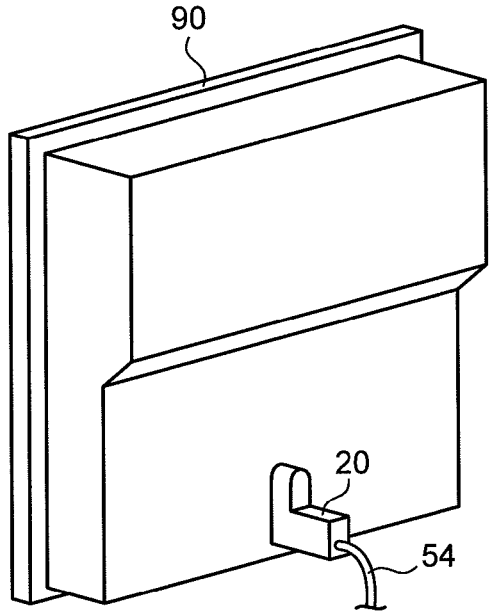
FIG. 14 is a perspective view of showing an exemplary application of the first embodiment, where the cable connector is connected to the rear side of a thin apparatus at right angle.

FIG. 14 is a perspective view of showing an application of the first embodiment, where the cable connector is connected to the rear side of a thin apparatus at right angle. A thin HMI 90 having a liquid crystal display includes a built-in PCB, not shown, arranged in parallel to the display unit. To connect the cable connector to the rear side of the thin apparatus, having the structure above, at right angle, it is effective to use the equipment-side connector 60 according to the first embodiment, which can be provided onto the PCB at right angle. It is preferable to use the disconnection preventing structure according to the first embodiment to prevent the equipment-side connector 60 from being damaged and the cable connector 50 from being disconnected from the equipment-side connector 60.

As described above, in the disconnection preventing structure according to the first embodiment, the holder 20 is fastened to the apparatus 80 with the fastening screw 29. Therefore, sufficient disconnection preventing force can be obtained, and the disconnection can be reliably prevented even if a heavy pulling weight (6 kilograms or greater) is applied. Furthermore, because the connector holding clamp 30 has a surrounding section (inserting hole 33) that surrounds the tip of the equipment-side connector 60, the connector damage, such as the opening of the equipment-side connector 60 being opened up or the equipment-side connector 60 being folded over, can be prevented, and the cable connector 50 can be prevented from being disconnected.

The effects of the present invention can be best achieved by combining the holder 20 and the connector holding clamp 30 according to the first embodiment; however, sufficient effects can be also achieved, by using the holder 20 or the connector holding clamp 30 by itself. In other words, if the holder 20 is used by itself, sufficient disconnection preventing force can be obtained for the cable connector 50, reliably preventing the cable connector 50 from being disconnected with a heavy pulling weight. If the connector holding clamp 30 is used by itself, connector damage can be prevented in a structure that the cable connector 50 is connected to the rear side of a thin apparatus at right angle, also to prevent the cable connector 50 from being disconnected.

Second Embodiment

Figure 15:
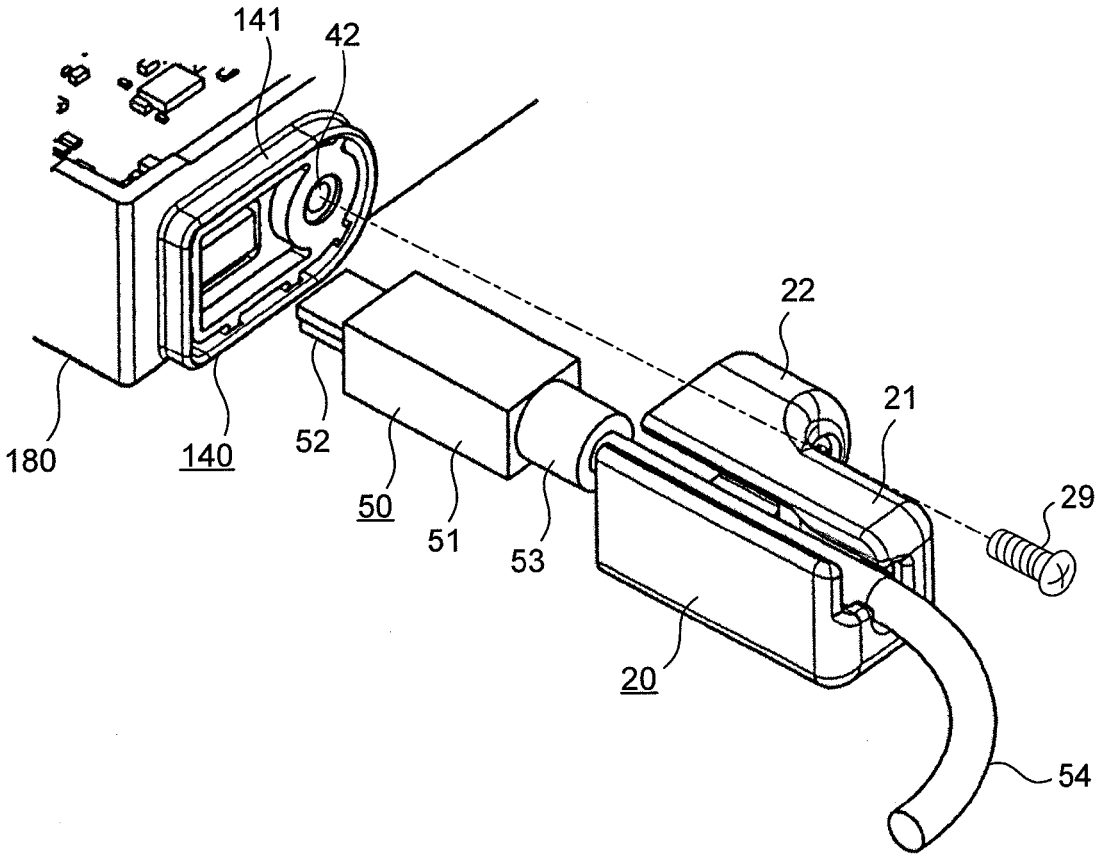
FIG. 15 is a perspective view for explaining a disconnection preventing structure according to a second embodiment of the present invention.

FIG. 15 is a perspective view for explaining a disconnection preventing structure according to a second embodiment of the present invention. In FIG. 15, on one lateral side of a thin apparatus 180, such as a notebook computer, a connector-connecting port is provided using a right-angle type equipment-side connector. A mounting base 140, onto which the holder 20 is mounted, is formed around the connector-connecting port. In other words, according to the second embodiment, the holder 20 is used by itself.

The mounting base 140 according to the second embodiment includes a surrounding wall 141 that surrounds the surface where the holder 20 is mounted. Therefore, the holder 20 is supported reliably, and the cable connector 50 is reliably prevented from being disconnected. At the same time, dust and water resistance of the connector-connecting port can be improved.

Third Embodiment

Figure 16:
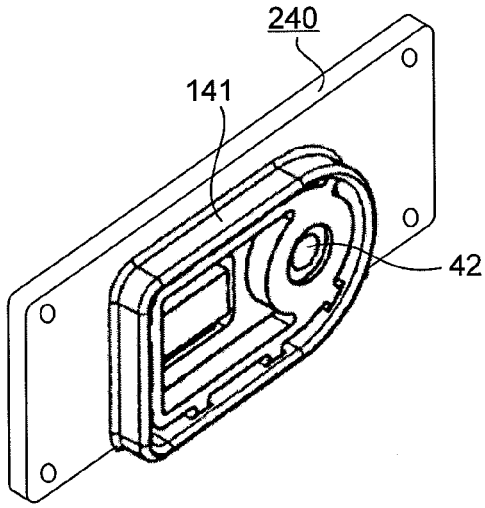
FIG. 16 is a perspective view of a mounting base piece, explaining a disconnection preventing structure according to a third embodiment of the present invention.

FIG. 16 is a perspective view of a mounting base piece, explaining a disconnection preventing structure according to a third embodiment of the present invention. In FIG. 16, a mounting base piece 240 according to the third embodiment has a shape achieved by cutting out the part, provided with the mounting base 140, of the lateral side of the thin apparatus 180 according to the second embodiment. To enable the holder 20 to be used, the mounting base piece 240 is adhered around a connector-connecting port of a generally-available apparatus, using an adhesive agent or strong double-sided tape. The mounting base piece 240 can be manufactured from resin such as by injection molding. The female screw hole 42 may also be embedded with a metal nut, for example, to secure fastening.

Fourth Embodiment

Figure 17:
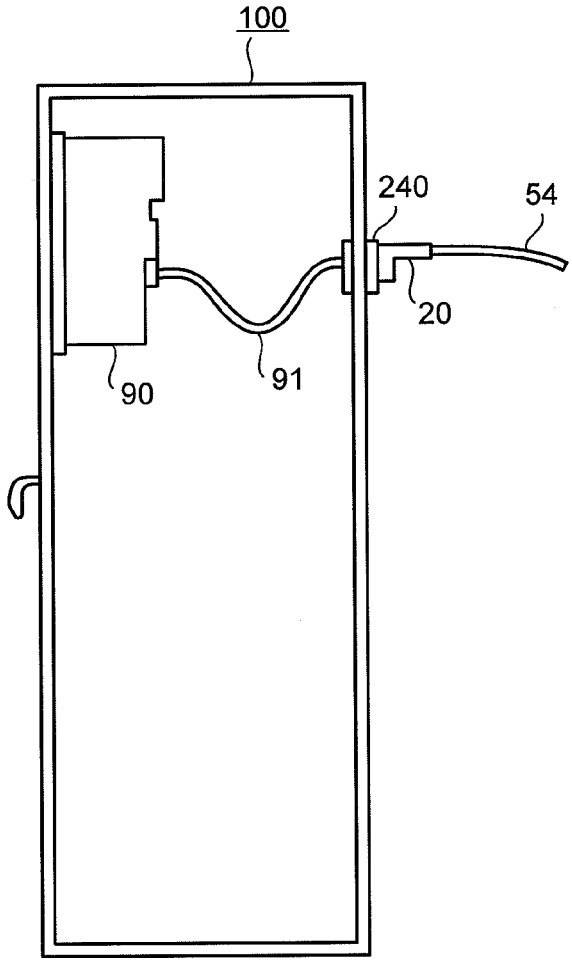
FIG. 17 is a vertical cross sectional view of a box-type control panel, explaining a disconnection preventing structure according to a fourth embodiment of the present invention.

FIG. 17 is a vertical cross-sectional view of a box-type control panel, explaining a disconnection preventing structure according to a fourth embodiment of the present invention. In the disconnection preventing structure according to the fourth embodiment, the mounting base piece 240 according to the third embodiment is fixed onto the rear side of a box-type control panel 100 that encloses, for example, the thin HMI 90 having a liquid crystal display. The equipment-side connector is provided on the inner surface, at a position facing the mounting base piece 240 on the rear side of the control panel, and connected to the HMI 90 using a USB extension cable 91.

Figure 18:
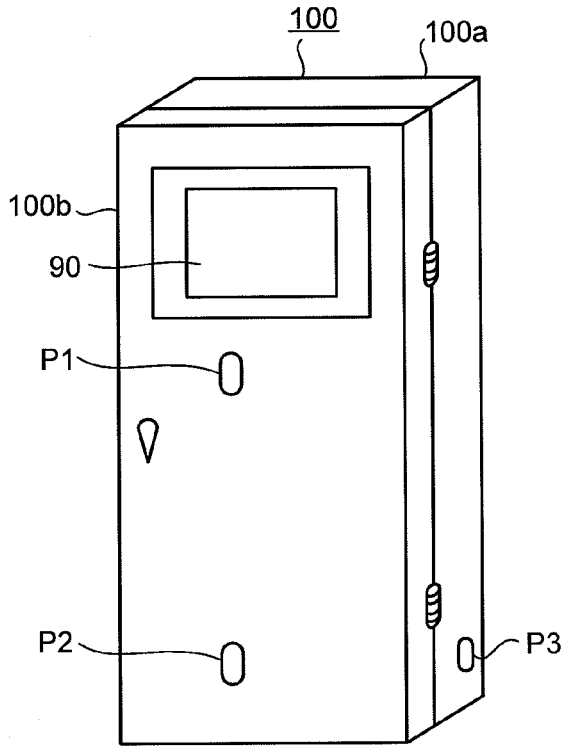
FIG. 18 is a perspective view of the box-type control panel, seen from a front side thereof, explaining another example of the disconnection preventing structure according to fourth embodiment.
Figure 19:
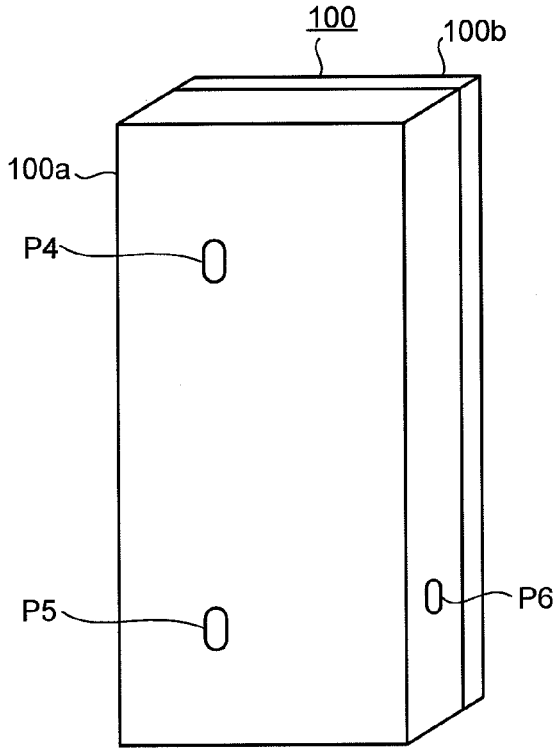
FIG. 19 is a perspective view of the box-type control panel, seen from a rear side thereof, explaining still another example of the disconnection preventing structure according to fourth embodiment.

FIG. 18 is a perspective view of the box-type control panel, seen from the front side thereof, for explaining another example of the disconnection preventing structure according to the fourth embodiment. FIG. 18 is a perspective view of the same box-type control panel, seen from the rear side thereof. The box-type control panel 100 includes a box-shaped main body 10*a*, and a door 100*b* that is provided to the main body 100*a* and can be freely opened and closed. The HMI 90 is arranged at the upper portion of the door 100*b*. The mounting base piece 240 is provided positions such as an upper section of the front side of the door 100*b* (P1 in FIG. 18), a lower section of the front side of the door 100*b* (P2 in FIG. 18), a lower section of the lateral side of the main body 100*a* (P3 in FIG. 18, P6 in FIG. 19), an upper section of the rear side of the main body 100*a* (P4 in FIG. 19), or a lower section of the rear side of the main body 100*a* (P5 in FIG. 19). This structure allows the cable connector to be inserted or removed without opening and closing the door 100*b*.

Fifth Embodiment

Figure 20:
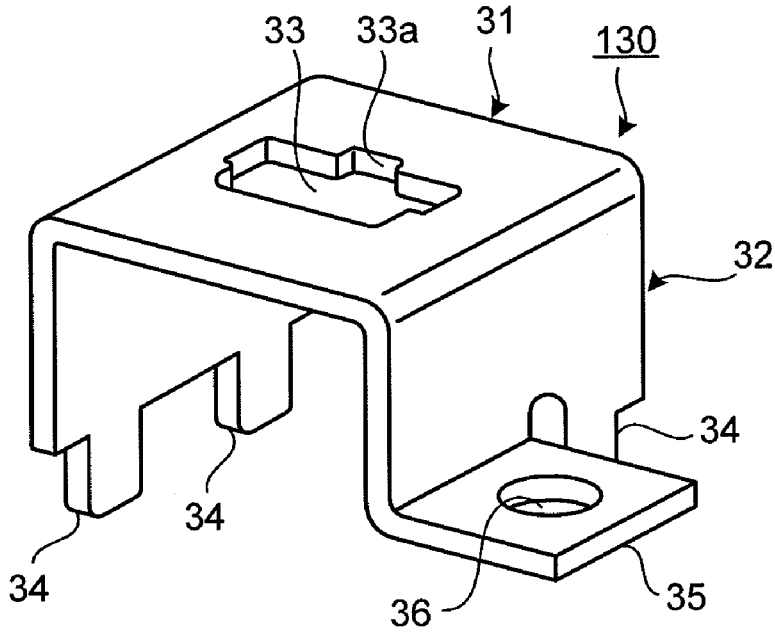
FIG. 20 is a perspective view of a connector holding clamp, explaining a disconnection preventing structure according to a fifth embodiment of the present invention.

FIG. 20 is a perspective view of a connector holding clamp, explaining a disconnection preventing structure according to a fifth embodiment of the present invention. In comparison with the connector holding clamp 30 according to the first embodiment, a connector holding clamp 130 according to the fifth embodiment lacks the coupling section 37. The connector holding clamp 130 is effective in using the connector holding clamp 30 by itself.

Sixth Embodiment

Figure 21:
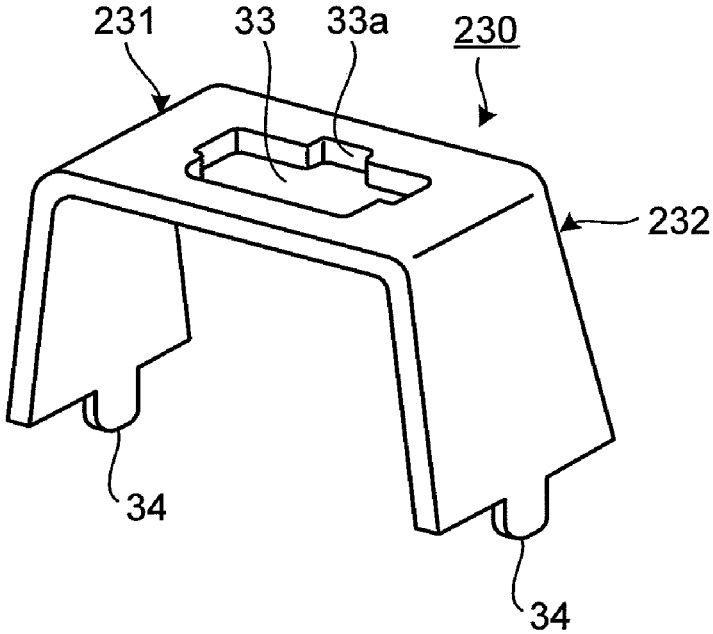
FIG. 21 is a perspective view of a connector holding clamp, explaining a disconnection preventing structure according to a sixth embodiment of the present invention.

FIG. 21 is a perspective view of a connector holding clamp, explaining a disconnection preventing structure according to a sixth embodiment of the present invention. In comparison with the connector holding clamp 130 according to the fifth embodiment, a connector holding clamp 230 according to the sixth embodiment lacks the mounting flange 35, an upper panel section 231 and foot sections 232 have smaller widths, and the number of the soldering tabs 34 is reduced. The connector holding clamp 230 having such a structure is effective for those that do not need to be earthed to the signal ground, and especially effective for those needing to be reduced in size in some sacrifice of the supportability.

Seventh Embodiment

Figure 22:
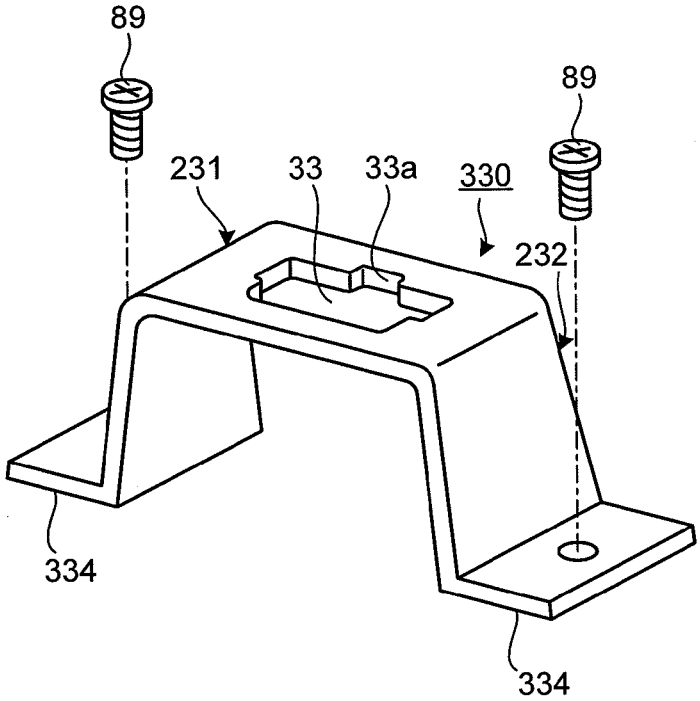
FIG. 22 is a perspective view of a connector holding clamp, explaining a disconnection preventing structure according to a seventh embodiment of the present invention.

FIG. 22 is a perspective view of a connector holding clamp, explaining a disconnection preventing structure according to a seventh embodiment of the present invention. A connector holding clamp 330 according to the seventh embodiment has mounting flanges 334, provided at the lower ends of the two foot sections 232 of the connector holding clamp 230 according to the sixth embodiment. The connector holding clamp 330 is fixed onto the PCB with the fixing screws 89, penetrating through a penetrating hole provided on each of mounting flanges 334 to securely fix the foot sections 232 onto the PCB. In other words, both ends of the connector holding clamp 330 are screwed to and securely fixed onto the PCB.

Eighth Embodiment

Figure 23:
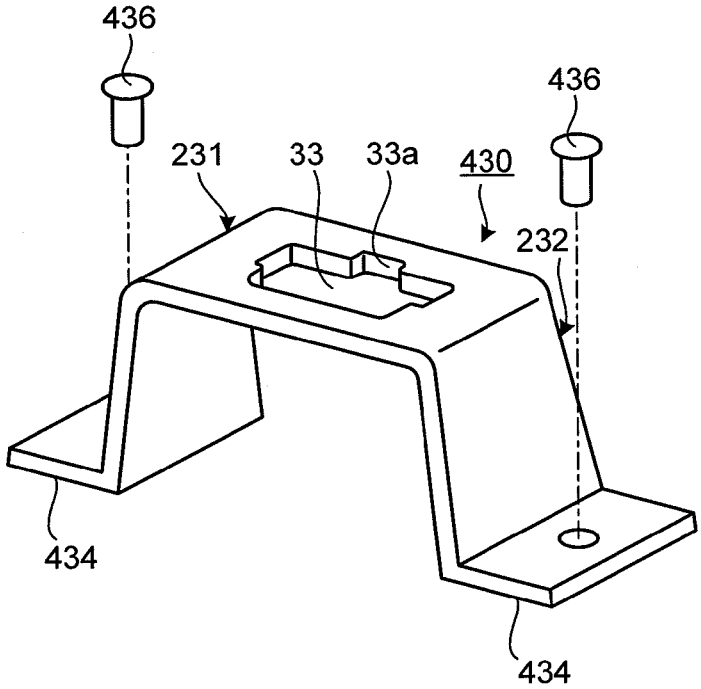
FIG. 23 is a perspective view of a connector holding clamp, explaining a disconnection preventing structure according to an eighth embodiment of the present invention.

FIG. 23 is a perspective view of a connector holding clamp, explaining a disconnection preventing structure according to an eighth embodiment of the present invention. A connector holding clamp 430 according to the eighth embodiment improves manufacturability and reduces a cost for the connector holding clamp 330 according to the seventh embodiment. The connector holding clamp 430 is fixed onto the PCB using rivets 436 penetrating through the penetrating holes formed on mounting flanges 434, respectively provided at the lower ends of the foot section 232. In other words, both ends of the connector holding clamp 430 are securely fixed onto the PCB by crimping the rivets.

Ninth Embodiment

Figure 24:
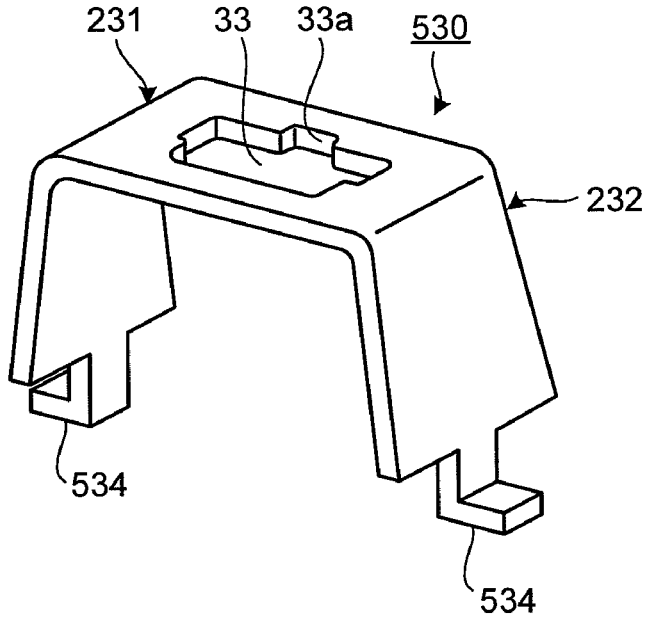
FIG. 24 is a perspective view of a connector holding clamp, explaining a disconnection preventing structure according to a ninth embodiment of the present invention.

FIG. 24 is a perspective view of a connector holding clamp, explaining a disconnection preventing structure according to a ninth embodiment of the present invention. A connector holding clamp 530 according to the ninth embodiment further improves the manufacturability and further reduces the cost of the connector holding clamp 430 according to the eighth embodiment. Folding tabs 534, respectively provided at the lower ends of the foot sections 232, are folded and crimped behind the PCB to fix the connector holding clamp 530 onto the PCB. In other words, the folding tabs 534, respectively provided at each end of the connector holding clamp 530, are crimped to fix the connector holding clamp 530 onto the PCB.

Tenth Embodiment

Figure 25:
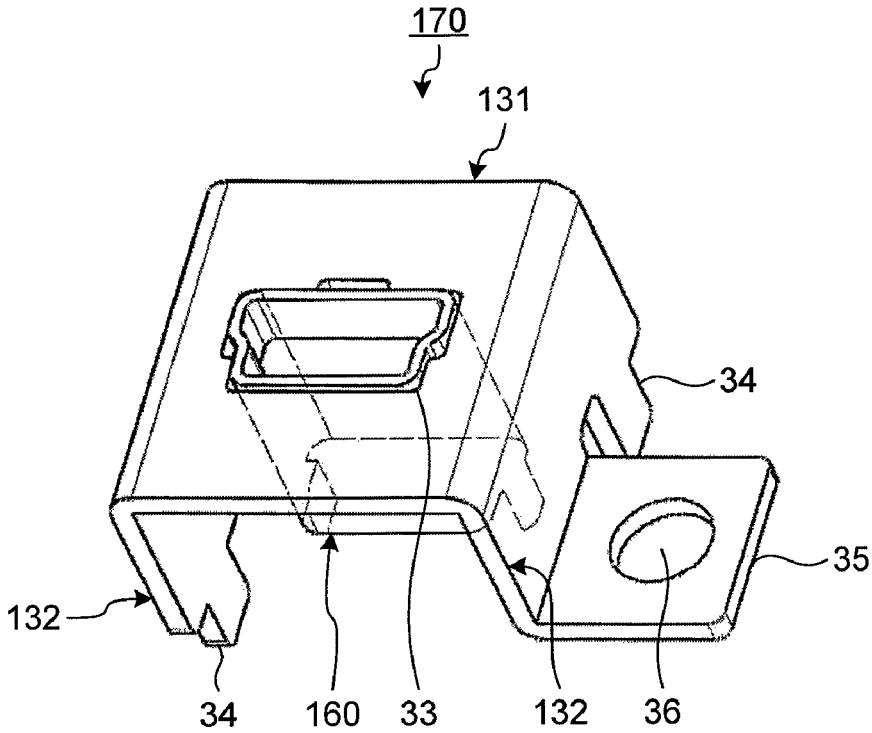
FIG. 25 is a perspective view of a reinforced equipment-side connector, explaining a disconnection preventing structure according to a tenth embodiment of the present invention.

FIG. 25 is a perspective view of a reinforced equipment-side connector, explaining a disconnection preventing structure according to a tenth embodiment of the present invention. A reinforced equipment-side connector 170 according to the tenth embodiment has a structure in which the equipment-side connector 60 according to the first embodiment is integrated with the connector holding clamp 130 according to the fifth embodiment. The reinforced equipment-side connector 170 includes: a longitudinal-type connector section 160 provided onto the PCB of an apparatus, not shown, at right angle; an upper panel section 131 arranged approximately in parallel to the PCB and having the inserting hole 33 for inserting the tip of the connector section 160; and a pair of foot sections 132 supporting the upper panel section 131 on the PCB. The upper panel section 131 and the foot sections 132 make up a supporting member that supports the tip of the connector section 160 on the PCB.

The connector section 160 generally has the same structure as the equipment-side connector 60 according to the first embodiment. The inserting hole 33, approximately the same in shape as the one provided to the upper panel section 31 of the connector holding clamp 30 according to the first embodiment, is provided on the upper panel section 131. A tip of the connector section 160 is inserted into the inserting hole 33, and soldered together to be integrated therewith. One of the foot sections 32, provided to each side of the upper panel section 31, has two of the soldering tabs 34 at a bottom end thereof. The other foot section 32 has the single soldering tab 34 and the mounting flange 35 at a bottom end thereof. The mounting flange 35 includes the penetrating hole 36 for fastening. The connection between the connector section 160 and the upper panel section 131 is not limited to soldering, but also may be adhered with an adhesive agent or welded together.

The reinforced equipment-side connector having the structure above includes the connector section, the upper panel section having the inserting hole inserted with the tip of the connector section, and the foot sections for supporting the upper panel section on the PCB. Therefore, the equipment-side connector can be prevented from being damaged reliably, such as opening thereof being opened up, or being folded over.

Eleventh Embodiment

Figure 26:
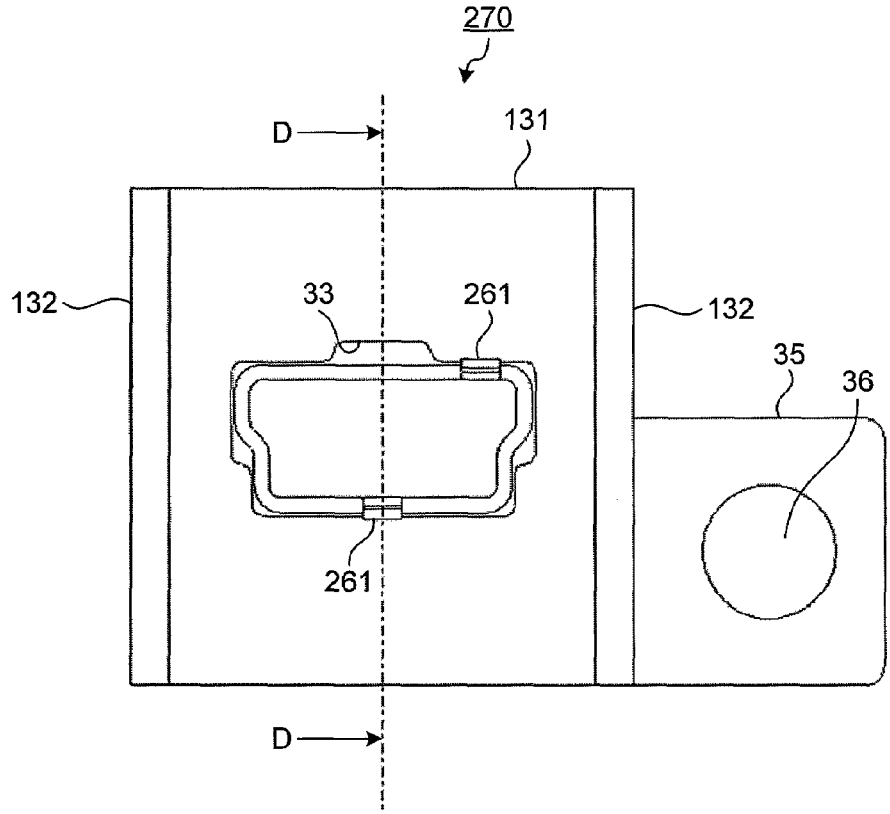
FIG. 26 is a top view of a reinforced equipment-side connector, explaining a disconnection preventing structure according to an eleventh embodiment of the present invention.
Figure 27:
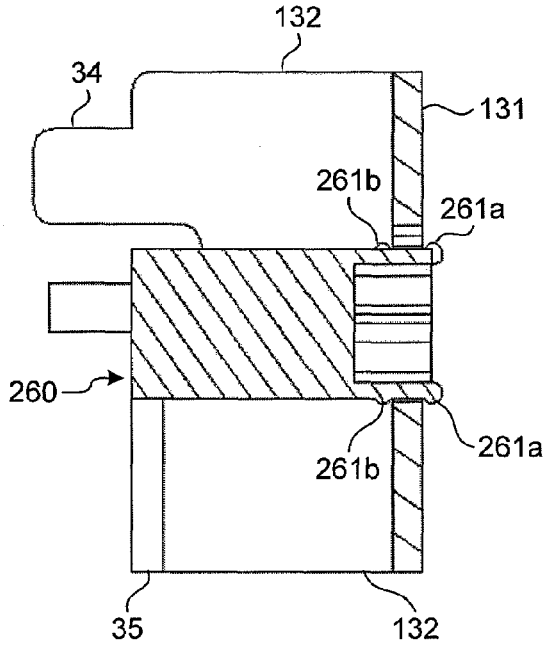
FIG. 27 is a sectional view along the line D-D shown in FIG. 26, seen from the direction of arrows.

FIG. 26 is a top view of a reinforced equipment-side connector, explaining a disconnection preventing structure according to an eleventh embodiment of the present invention. FIG. 27 is a sectional view along the line D-D shown in FIG. 26, seen from the direction of arrows. In a reinforced equipment-side connector 270, a connector section 260 is connected to the upper panel section 131 by way of engaging sections 261 formed at two locations on the edge of the opening of the connector section 260. The engaging section 261 includes an upper protrusion 261*a* provided on the edge of the opening at the tip, and a lower protrusion 261*b* arranged behind from the tip and facing to the upper protrusion 261*a*. An internal surface of the inserting hole 33 on the upper panel section 131 is nipped by and engages to these two protrusions 261*a*, 261*b*. In this manner, the connector section 160 is engaged into the upper panel section 131 to become connected. Remaining elements of the structure are the same as those according to the tenth embodiment.

In the reinforced equipment-side connector having the structure described above, the connector section 160 is engaged into the upper panel section 131 to become connected. Therefore, the connecting process can be simplified.

In the tenth and the eleventh embodiments, the upper panel section 131 may include the coupling section 37, as required, threaded with the linking screw hole 38 through which the fastening screw 29 penetrates, passing through the fastening section 22 of the holder 20, in the same manner as in the upper panel section 31 according to the first embodiment. The mounting flange 35 may be omitted as appropriate, if there is no need to earth to the signal ground.

Twelfth Embodiment

Figure 28:
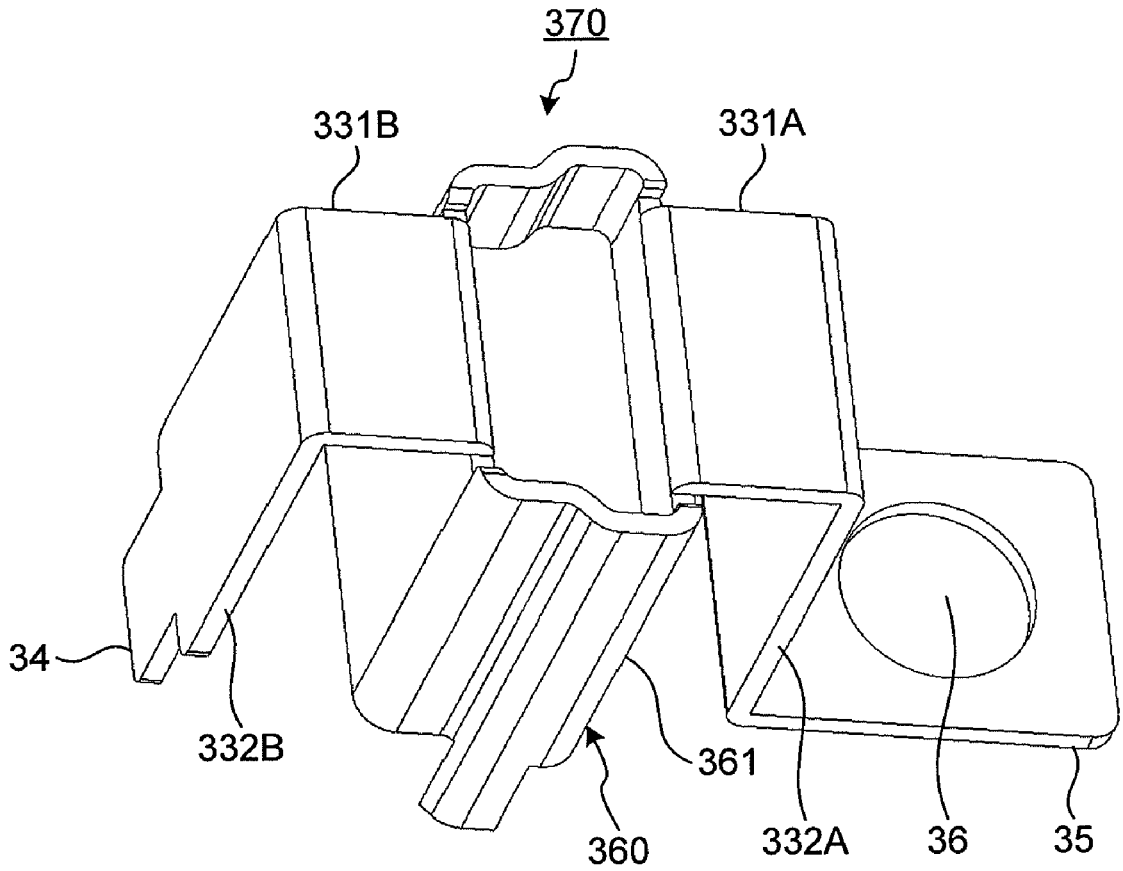
FIG. 28 is a perspective view of a reinforced equipment-side connector, explaining a disconnection preventing structure according to a twelfth embodiment of the present invention.

FIG. 28 is a perspective of a reinforced equipment-side connector, explaining a disconnection preventing structure according to a twelfth embodiment of the present invention. A reinforced equipment-side connector 370 according to the twelfth embodiment includes: a longitudinal-type connector section 360 provided onto the PCB of an apparatus, not shown, at right angle; a first upper panel section 331A and a second upper panel section 331B, each of which extends from a connecting-side opening edge of the connector section 360 in parallel in opposing directions; and a first foot sections 332A and a second foot sections 332B, bending toward the PCB from one end of the upper panel sections 331A, 331B, respectively. The mounting flange 35, having the penetrating hole 36 for fastening, is provided at a bottom end of the first foot section 332A. The soldering tab 34 is provided at a bottom end of the second foot section 332B. The upper panel sections 331A, 331B and the foot sections 332A, 332B make up a supporting member that supports the tip of the connector section 360 on the PCB.

The upper panel sections 331A, 331B and the foot sections 332A, 332B are formed by extending a thin metal plate, forming a shell 361 of the connector section 360, toward the connector-connecting side by a predetermined length, and by folding the extended section. Therefore, the number of components can be reduced, and a connecting process for the upper panel sections 331A, 331B and the connector section 360 can be omitted.

INDUSTRIAL APPLICABILITY

As described above, the connector retaining holder, the connector holding clamp, and the connector retaining structure according to the present invention is suited for preventing disconnection of a small-sized connector, such as USB standard connector, connected to an FA apparatus, and especially most suited for preventing an equipment-side connector from being damaged, and a cable connector from being disconnected, in a structure where the cable connector is connected to the rear side of a thin apparatus at right angle.

The invention claimed is:

1. A connector supporting clamp comprising:

a longitudinal-type equipment-side connector;

an upper panel section including an inserting hole into which a tip of the longitudinal-type equipment-side connector is inserted, the longitudinal-type equipment-side connector being mounted on a PCB of an equipment at a right angle and including a spring section formed on a lateral surface thereof; and a foot section that supports the upper panel section on the PCB, wherein an inner circumference of the inserting hole has a shape surrounding substantially an entire circumference of the tip of the equipment-side connector, and the foot section is provided at a position that opens up the lateral surface of the longitudinal-type equipment-side connector on which the spring section of the equipment-side connector is formed.

2. The connector supporting clamp according to claim 1, wherein an inner circumference rim of the inserting hole includes a clearance corresponding to the spring section of the equipment-side connector.

3. The connector holding clamp according to claim 1, wherein the upper panel section and the foot section are formed as a plate that is bent to have a U-shaped cross-section.

4. A connector supporting clamp comprising:

an upper panel section including an inserting hole into which a tip of a longitudinal-type equipment-side connector is inserted, the longitudinal-type equipment-side connector being mounted on a PCB of an equipment at a right angle and including a spring section formed on a lateral surface thereof; and a foot section that supports the upper panel section on the PCB, wherein an inner circumference of the inserting hole has a shape surrounding substantially an entire circumference of the tip of the equipment-side connector, and the foot section is provided at a position that opens up the lateral surface of the longitudinal-type equipment-side connector on which the spring section of the equipment-side connector is formed, wherein the foot section includes a tab that is formed at a bottom end of the foot section and has a plated surface.

5. A connector supporting clamp comprising:

an upper panel section including an inserting hole into which a tip of a longitudinal-type equipment-side connector is inserted, the longitudinal-type equipment-side connector being mounted on a PCB of an equipment at a right angle and including a spring section formed on a lateral surface thereof; and a foot section that supports the upper panel section on the PCB, wherein an inner circumference of the inserting hole has a shape surrounding substantially an entire circumference of the tip of the equipment-side connector, and the foot section is provided at a position that opens up the lateral surface of the longitudinal-type equipment-side connector on which the spring section of the equipment-side connector is formed, wherein the foot section is fixed to the PCB with a fixing screw passing through a mounting flange provided at a bottom end of the foot section, and the foot section is electrically connected to ground.

* * * * *